US005681037A

United States Patent [19]

Greive

[11] Patent Number: 5,681,037

[45] Date of Patent: Oct. 28, 1997

[54] DEVICE FOR FACILITATING SHEET SINGLING OR SEPARATION IN AN UPPER REGION OF A FEEDER PILE

[75] Inventor: Martin Greive, Heidelberg, Germany

[73] Assignee: Heidelberger Druckmaschinen AG, Heidelberg, Germany

[21] Appl. No.: 364,538

[22] Filed: Dec. 27, 1994

[30] Foreign Application Priority Data

Dec. 24, 1993 [DE] Germany ..... 9319902 U

[51] Int. Cl.[6] ..... B65H 3/08; B65H 3/48

[52] U.S. Cl. ..... 271/97; 271/105

[58] Field of Search ..... 271/97, 98, 105

[56] References Cited

U.S. PATENT DOCUMENTS

| | | | |
|---|---|---|---|
| 1,457,094 | 5/1923 | Thompson et al. | 271/105 |
| 2,402,442 | 6/1946 | Perry | 271/98 |
| 3,070,367 | 12/1962 | Schwebel | 271/98 X |
| 5,092,578 | 3/1992 | Bergmeier et al. | 271/97 |

FOREIGN PATENT DOCUMENTS

| | | |
|---|---|---|
| 1908992 | 10/1975 | Germany . |
| 2452052 | 5/1976 | Germany . |
| 3424814 | 3/1985 | Germany . |
| 3039481 | 5/1986 | Germany . |
| 421952 | 1/1935 | United Kingdom . |

*Primary Examiner*—F. J. Bartuska

*Attorney, Agent, or Firm*—Herbert L. Lerner; Laurence A. Greenberg

[57] ABSTRACT

Device for facilitating sheet separation in an upper region of a feeder pile, whereat a separating device is disposed for removing a respective uppermost sheet from the pile and feeding it to a further processing unit, includes a turnable bushing having a guide, and a blower having a vertically adjustable blower body mounted with preloading on the turnable bushing.

6 Claims, 3 Drawing Sheets

DEVICE FOR FACILITATING SHEET SINGLING OR SEPARATION IN AN UPPER REGION OF A FEEDER PILE

BACKGROUND OF THE INVENTION

FIELD OF THE INVENTION

The invention relates to a device for facilitating sheet singling or separation in an upper region of a feeder pile, the device being mounted preferably at a trailing edge of the feeder pile, from which a respective uppermost sheet is removed by singling or separating devices and fed to a further processing unit.

The published German Patent Document DE 34 24 814 A1 discloses a blower for a sheet feeder. In the vicinity of a trailing edge of a sheet pile, a blowing nozzle rotating about a vertical axis of rotation is mounted. The blowing nozzle is formed with an air outlet opening which is automatically varied proportionately by the quantity of blowing air supplied thereto. After the sheets have been singly separated by separating suckers, the blower is able to blow air under the respective separated sheets, thereby forming an air cushion for carrying the respective sheet. Because the blower rotates about a vertical axis of rotation, a drive must be provided therefor.

From the published German Patent Publication DE 30 39 481 C2, a device for separating a respective uppermost sheet of a sheet pile from the remaining sheets of the pile has become known heretofore. At the trailing edge of the pile, there is provided, between respective pairs of lifting suckers and respective pairs of forwarding or pull suckers, an additional device actuatable by suction air for holding up the trailing end of the lifted sheet. By means of a blower foot provided in the middle of the front end, blowing air is fed underneath the separated sheets. The additional device which is actuatable by suction air is mounted fixed in position so that new sheets are stackable into a sheet pile in the feeder region only with considerable difficulty.

The published German Patent Document DE 24 52 052 A1 relates to a method and a device for loosening up and separating a sheet from a feeder pile of sheet-fed rotary printing presses. Through compressed-air nozzles which are distributed along the trailing edge of the sheet pile, powder or a separating liquid is sprayed between the lifted sheet and the upper surface of the pile. This procedure is possible only at the uppermost sheet of the sheet pile, because the compressed-air nozzles are stationarily fastened at the trailing edge of the sheet pile.

The published German Patent Document DE-AS 19 08 992 shows pre-blowers which are disposed at the trailing edge of a feeder pile in the vicinity of separating suckers and forwarding or conveying suckers and which can be shifted or displaced in a vibrating movement in order to compensate for the possible existence of adhesive or holding forces between the sheets and to avoid the feeding of double sheets. The air jets discharging from the pre-blowers and passing over the upper pile region loosen up the upper pile region and thereby facilitate sheet separation or singling in the pile region.

SUMMARY OF THE INVENTION

It is accordingly an object of the invention to provide a device for facilitating sheet separation or singling in an upper region of a feeder pile which is more user-friendly than heretofore known devices of this general type.

With the foregoing and other objects in view, there is provided, in accordance with the invention, a device for facilitating sheet separation in an upper region of a feeder pile, whereat a separating device is disposed for removing a respective uppermost sheet from the pile and feeding it to a further processing unit, comprising a turnable bushing having guide means, and a blower having a vertically adjustable blower body mounted with preloading on the turnable bushing.

In accordance with another feature of the invention, the blower is disposed at a trailing edge of the feed pile.

In accordance with a further feature of the invention, the bushing is formed with grooves, and pins are fastened to said blower body and extend into said grooves.

In accordance with an added feature of the invention, the blower body is formed with a threaded portion, and a knurled-head screw is carried by the threaded portion of the blower body.

In accordance with an additional feature of the invention, the device includes means for deflecting the blower body in a vertical direction, and a compression spring in cooperative engagement with the bushing for returning the blower body to an original position thereof after the blower body has been deflected in the vertical direction.

In accordance with a concomitant feature of the invention, the device includes a support in which the bushing is turnably mounted, the bushing being formed with a knurled rim for turning the bushing in the support.

The turning of the blowers and the vertical adjustment thereof permits an optimal adaptation of the location of the blowing-air supply to the printing material of different weights which is to be processed. The arrangement of the blowers are arranged ensures an easy accessibility thereto, even when the printing press is running.

As aforementioned, the blower bodies are provided with pins which extend into the grooves formed in a respective bushing, and are thereby secured against relative rotation. If a knurled-head screw, which is mounted on a threaded portion at an upper end of the blower body, is turned, the blower body moves in a vertical direction. An upward movement of the blower body possibly caused by a pile table abutting against the blower body from below is compensated for by a compression spring provided between the blower body and the bushing; the blower body resumes its originally adjusted position. The blower as a whole is adjustable by turning the bushing in the support. For this purpose, the bushing is provided with a knurled rim to improve the grippability thereof.

Other features which are considered as characteristic for the invention are set forth in the appended claims.

Although the invention is illustrated and described herein as embodied in a device for facilitating sheet separation or singling in an upper region of a feeder pile, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

DESCRIPTION OF THE PREFERRED EMBODIMENTS

Figure 1:
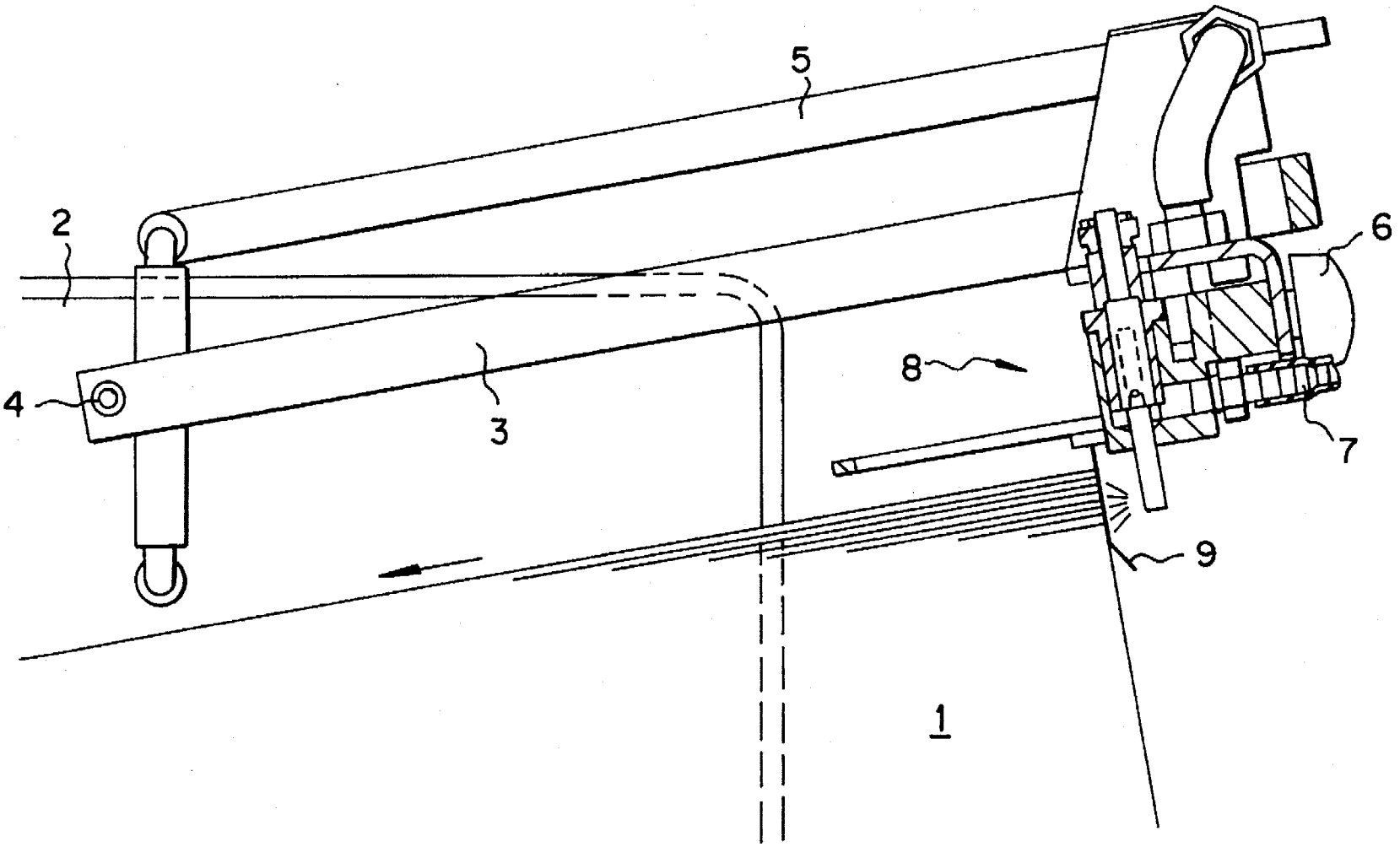
FIG. 1 is a fragmentary side elevational view, partly in section, of an upper portion of a feeder pile having blowers fastened to a frame.

Referring now to the drawings and, first, particularly to FIG. 1 thereof, there is shown therein, in a side-elevational view, a feeder sheet pile 1 which is inclined with respect to side element 2 of the feeder. A frame 3 which is swivellable about a swivel axis 4 is equipped with a supply line 5 via which blowing air is supplied to a blower 8. Reference numeral 7 identifies a connecting piece connecting the supply line 5 to the blower 8. Adjacent to the blower 8 are stops 9 for maintaining a respective uppermost sheet in a correct position on the pile 1. By means of a tommy or capstan-head screw 6, the blower 8 can be moved in horizontal direction on a traverse carrying the blower, as shown more clearly in FIG. 3.

Figure 2:
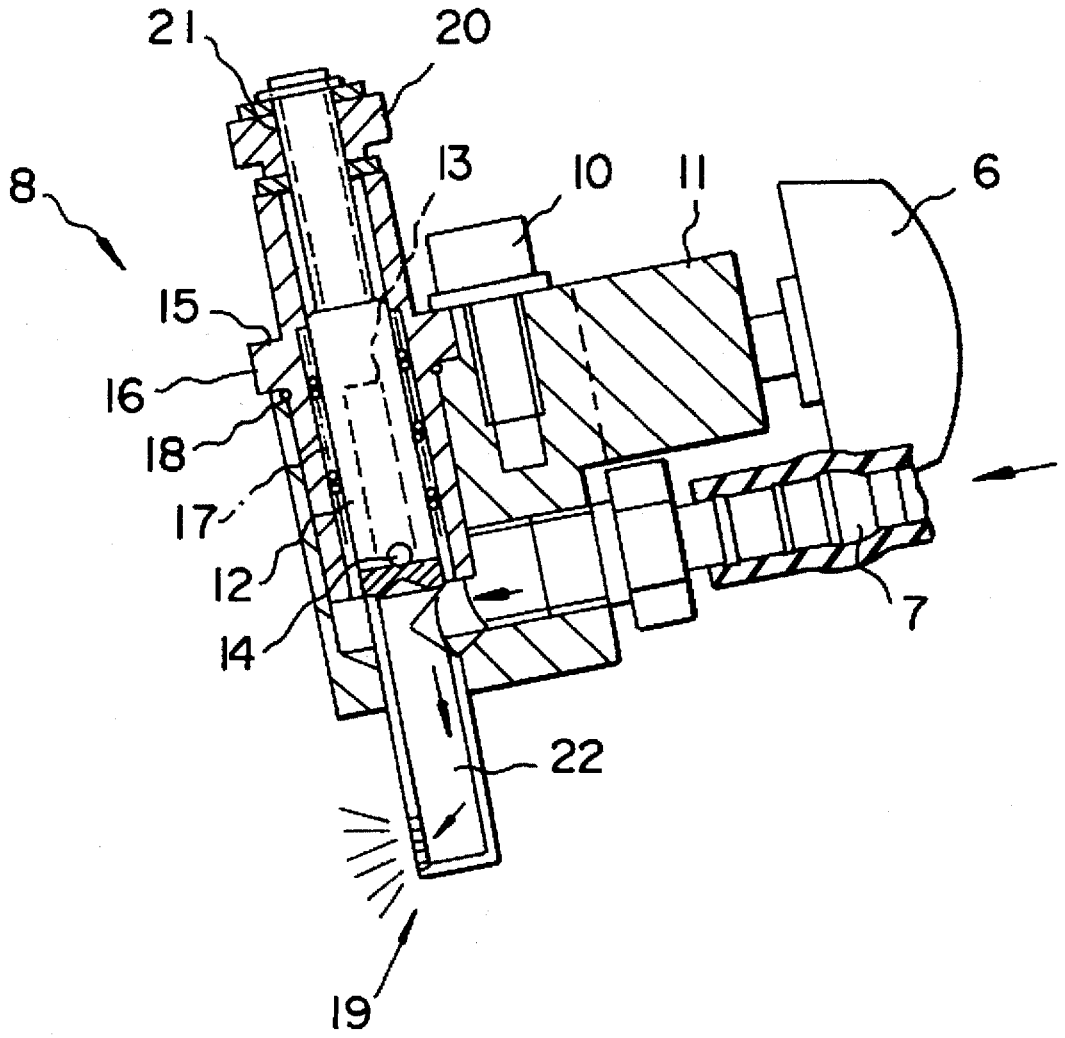
FIG. 2 is an enlarged fragmentary view of FIG. 1 showing one of the blowers according to the invention in greater detail.

From the enlarged cross-sectional view of the blower 8 in FIG. 2, it is apparent that a bushing 15 is turnably received or embedded in a support 11. The bushing 15 is fastened in the support 11 by means of a screw 10 and a washer so that it remains barely turnable. The bushing 15 is formed with a knurled rim 16 so as to improve the grippability thereof, and thereby facilitating the turning thereof. Between the support 11 and the bushing 15, a sealing ring 18 is provided below the knurled rim 16.

A blower body 12 is disposed in the bushing 15. Pins 14 extending into grooves 13 formed in the bushing 15 and serving to fix the blower body 12 in the bushing 15 against rotation relative thereto are fastened to the sides of the blower body 12. A thread 21 is formed on an upper portion of the blower body 12 and receives a knurled-head screw 20 thereon. The knurled-head screw 20 is braced against an upper rim of the bushing 15. If the bushing 15 is turned, the blower body 12 is forced to perform a perpendicular movement, due to the pins 14 which run in the grooves 13 and serve for fixing the blower body 12 against rotation relative to the bushing 15.

An air duct 22 is formed in a lower portion of the blower body 12 and is connected to the connecting piece 7 through a bore formed in the blower body 12. Furthermore, outlet orifices 19 through which the air jets leave the duct 22 and engage with an upper region of the pile edge are located at the lower portion of the blower body 12. Between the bushing 15 and the blower body 12, a compression spring 17 is provided which causes the blower body 12 to return to its originally adjusted position after having been unintentionally deflected in a vertical direction.

Figure 3:
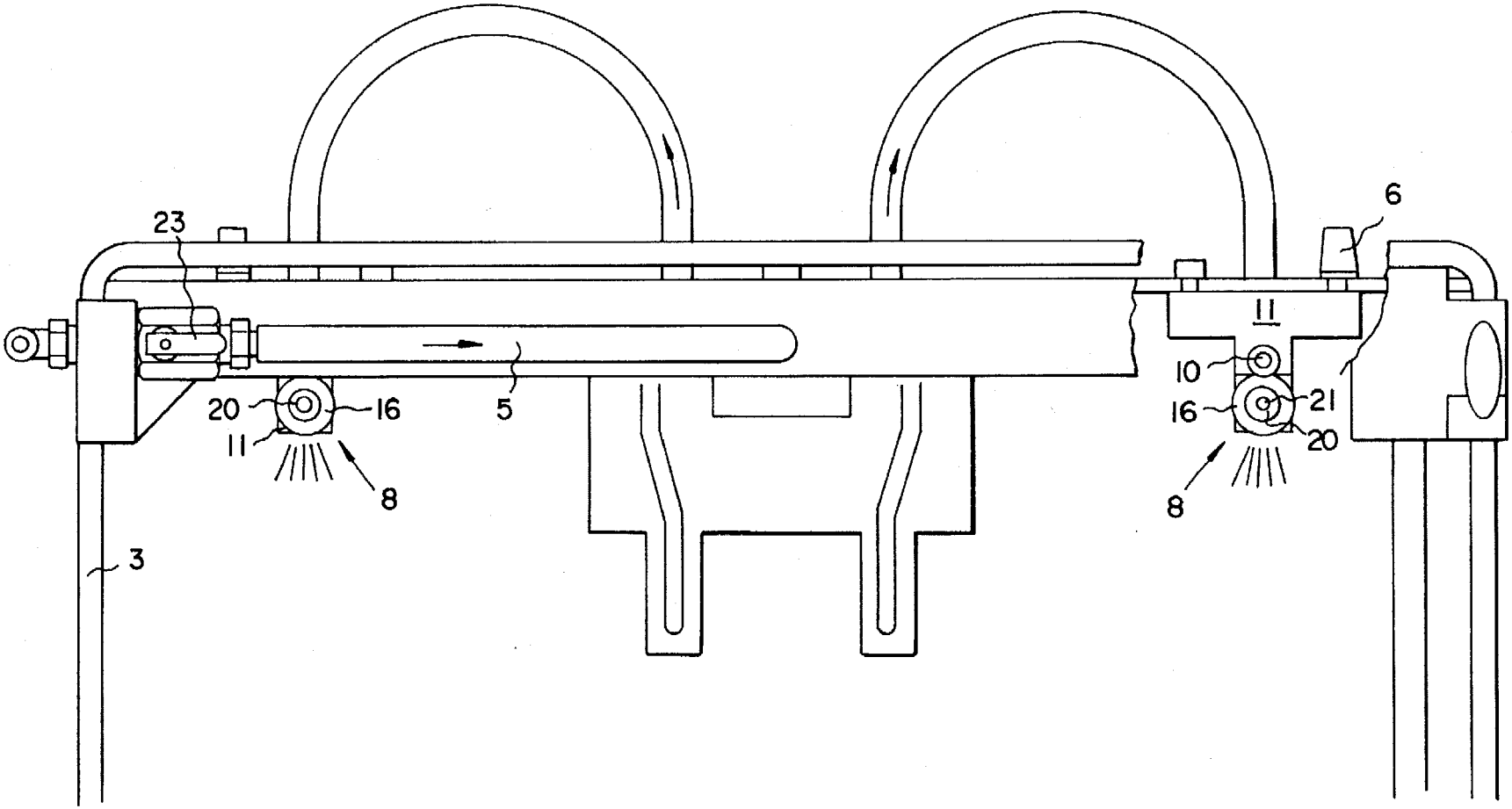
FIG. 3 is a top plan view of FIG. 1 rotated 90 degrees counter-clockwise and showing the air-supply system for the blowers fastened to the frame.

In the top plan view according to FIG. 3, the supply line 5 for the blowers 8 is shown equipped with a stopcock 23. Each of the blowers 8 has a separate blowing-air supply line formed of flexible material mounted on the frame 3. A result thereof is that the supports 11 of the blowers 8 can be displaced without hindrance in horizontal direction, after the respective knurled-head screw 6 has been loosened, and can be locked again in any selected position by means of the knurled-head screw 6. Furthermore, FIG. 3 shows that the supports 11 are guided on a traverse by means of a further screw head 20, in addition to the knurled screw 6. Above the respective support 11 is a screw 10, by means of which the bushing 15 is clamped, above the knurled rim 16, in the support 11. Above the knurled rim 16, the knurled-head screw 20 rests on the partly projecting threaded portion 21 and produces the vertical movement of the blower bodies 12 in the bushing 15.

I claim:

1. Device for facilitating sheet separation in an upper region of a feeder pile, whereat a separating device is disposed for removing a respective uppermost sheet from the pile and feeding it to a further processing unit, comprising a substantially vertically oriented turnable bushing having guide means, and a blower having a vertically adjustable blower body mounted with preloading coaxially within said turnable bushing and said blower being movable in a horizontal direction on a swivellable frame for separating a top most sheet in a non-contacting manner.

2. Device according to claim 1, wherein said blower is disposed at a trailing edge of the feed pile.

3. Device according to claim 1, wherein said bushing is formed with grooves, and including pins fastened to said blower body and extending into said grooves.

4. Device according to claim 1, wherein said blower body is formed with a threaded portion, and including a knurled-head screw carried by said threaded portion of said blower body.

5. Device according to claim 1, including means for deflecting said blower body in a vertical direction, and a compression spring in cooperative engagement with said bushing for returning said blower body to an original position thereof after said blower body has been deflected in said vertical direction.

6. Device according to claim 1, including a support in which said bushing is turnably mounted, said bushing being formed with a knurled rim for turning said bushing in said support.

* * * * *